US006178903B1

(12) United States Patent
Bondanza et al.

(10) Patent No.: US 6,178,903 B1
(45) **Date of Patent: *Jan. 30, 2001**

(54) WEB-FED CHAIN-STITCH SINGLE-NEEDLE MATTRESS COVER QUILTER WITH NEEDLE DEFLECTION COMPENSATION

(75) Inventors: James Bondanza, Tamarac; Roland Bulnes, Margate; Terrance L. Myers, Coral Springs; Jeff Kaetterhenry, Davie; James T. Frazer, Coral Springs; Glenn E. Leavis, Hollywood, all of FL (US)

(73) Assignee: L&P Property Management Company, South Gate, CA (US)

( * ) Notice: Under 35 U.S.C. 154(b), the term of this patent shall be extended for 0 days.

This patent is subject to a terminal disclaimer.

(21) Appl. No.: 09/189,656

(22) Filed: Nov. 10, 1998

Related U.S. Application Data

(63) Continuation-in-part of application No. 08/831,060, filed on Apr. 1, 1997, now Pat. No. 5,832,849.

(51) Int. Cl.[7] ..... D05B 11/00

(52) U.S. Cl. ..... 112/117; 112/470.13; 112/475.08; 112/221

(58) Field of Search ..... 112/117, 118, 112/119, 155, 475.08, 220, 221, 470.01, 470.12, 470.13

(56) References Cited

U.S. PATENT DOCUMENTS 2,119,341 5/1938 Milner .

3,559,600 2/1971 Kalning .

(List continued on next page.)

*Primary Examiner*—Peter Nerbun
(74) *Attorney, Agent, or Firm*—Wood, Heron, & Evans, L.L.P.

(57) ABSTRACT

A quilting machine is provided having at least one set of single needle stitch forming elements for forming chain stitched patterns on a thick multilayered material such as a mattress cover. The machine is preferably web-fed, with a panel of the continuous web being clamped and held stationary on a frame. The stitch forming elements include a needle and a looper mounted on separate heads that are independently moveable on a bridge transversely relative to the panel, which is moveable longitudinally relative to the frame. The bridge is longitudinally moved by a servo and the heads are transversely moved on the bridge by separate servos. The stitching elements on each head are driven by separate servos. A controller drives the servos to chain stitch patterns and differentially move the heads transversely to account for transverse needle deflection. The drives of the needle and looper are phased to compensate for longitudinal needle deflection. The controller determines or predicts needle deflection. It may store empirically determined data and respond to control signals and/or sensors to determine or predict deflection and to calculate the needle deflection compensation, in response to which it generates deflection compensation signals to drive the servos. Infrared, LED or magnetic deflection sensors are preferred, but many other types are or will become available that will be suitable.

19 Claims, 5 Drawing Sheets

U.S. PATENT DOCUMENTS

| | | | |
|---|---|---|---|
| 3,727,069 | 4/1973 | Crittenden, Jr. et al. . | |
| 3,871,309 | 3/1975 | Frost . | |
| 3,989,239 | 11/1976 | Scriven, Jr. et al. . | |
| 4,157,686 | 6/1979 | Hager et al. . | |
| 4,173,191 | 11/1979 | Taddicken . | |
| 4,353,539 | 10/1982 | Doyen et al. . | |
| 4,493,276 | 1/1985 | Sadeh . | |
| 4,649,842 | 3/1987 | Backmann . | |
| 4,664,367 | 5/1987 | Vergnetti . | |
| 4,664,577 | 5/1987 | Bonali . | |
| 4,669,400 | 6/1987 | Michaels et al. . | |
| 4,953,483 | 9/1990 | Brower et al. . | |
| 5,018,463 | 5/1991 | Nakajima . | |
| 5,040,473 | 8/1991 | Zesch et al. . | |
| 5,103,747 | 4/1992 | Resta et al. . | |
| 5,136,955 | 8/1992 | Resta et al. . | |
| 5,154,130 | 10/1992 | Gribetz et al. . | |
| 5,287,820 | 2/1994 | Stuznacker . | |
| 5,425,319 | 6/1995 | Resta et al. . | |
| 5,458,075 | 10/1995 | Tice et al. . | |
| 5,637,866 | 6/1997 | Riener et al. . | |
| 5,640,916 | 6/1997 | Kaetterhenry et al. . | |
| 5,762,014 | 6/1998 | JeanBlanc . | |
| 5,791,272 * | 8/1998 | Akahane et al. | 112/220 |
| 5,832,849 | 11/1998 | Keatterhenry et al. . | |
| 5,839,382 | 11/1998 | Tice et al. . | |
| 5,913,276 * | 6/1999 | Kurono et al. | 112/470.01 |

* cited by examiner

WEB-FED CHAIN-STITCH SINGLE-NEEDLE MATTRESS COVER QUILTER WITH NEEDLE DEFLECTION COMPENSATION

This is a continuation-in-part of the and commonly assigned U.S. application Ser. No. 08/831,060 filed on Apr. 01, 1997 now U.S. Pat. No. 5,832,849, hereby expressly incorporated by reference herein.

FIELD OF THE INVENTION

The present invention relates to the quilting of patterns on multiple layer materials, and particularly to the stitching of 360° patterns on thick multilayer materials such as mattress covers.

BACKGROUND OF THE INVENTION

Quilting is a special art in the general field of sewing in which patterns are stitched through a plurality of layers of material over a two-dimensional area of the material. The multiple layers of material normally include at least three layers, one a woven primary or facing sheet having a decorative finished quality, one a usually woven backing sheet that may or may not be of a finished quality, and one or more internal layers of thick filler material, usually of randomly oriented fibers. The stitched patterns maintain the physical relationship of the layers of material to each other as well as provide ornamental qualities. Quilting is performed on the customary quilts or comforters and on the covers of mattresses, for example. In the stitching of quilts for these two applications, two different approaches are typically used. Both approaches use stitches that employ both a top and a bottom thread.

Single needle quilters of the type illustrated and described in U.S. Pat. Nos. 5,640,916 and 5,685,250, hereby expressly incorporated by reference herein, and those patents cited and otherwise referred to therein are customarily used or the stitching of comforters and other preformed rectangular panels. Such single needle quilters typically use a pair of cooperating a lock stitch sewing heads, one carrying a needle drive that is typically positioned above the fabric and one carrying a bobbin that is opposite the fabric from the needle, with both heads being mechanically linked to move together in two dimensions, relative to the panel, parallel to the plane of the panel. A common arrangement of this type of quilting apparatus is to support the panel of fabric on a longitudinally moveable shuttle with the sewing heads moveable transversely of the panel to provide two-dimensional stitching capability of the pattern on the panel.

Multiple needle quilters of the type illustrated in U.S. Pat. No. 5,154,130 are customarily used for the stitching of mattress covers, which are commonly formed from multi-layered web-fed material. Such multi-needle quilters typically use an array of cooperating a double chain stitch sewing elements, one element being a needle that is typically positioned above the material and one element being a looper that is opposite the material from the needle, with the entire arrays of both elements being mechanically linked together to move in unison in two dimensions, relative to the material, parallel to the plane of the material in paths that corresponds to identical patterns of a pattern array. The needles and loopers also operate in unison so that the sets of elements simultaneously form identical series of stitches. A common arrangement of this type of quilting apparatus is to support the panel of multilayered material and feed the material from a web longitudinally relative to the sewing element array and in coordination with the motion and operation of the sewing elements. The sewing element array may be shiftable transversely of the web to provide two-dimensional stitching capability of the pattern on a panel length of the web. Alternatively, the array is stationary and rollers that support the web shift transversely relative to the array. Some multi-needle quilters of this type have longitudinally bi-directional web feeding capability which, when synchronized with the transverse shifting of the web or the sewing elements, provides for 360° pattern sewing capability.

The single needle quilters are regarded as preferable for the sewing of a wider range of patterns and particularly more highly decorative patterns. In addition, in single needle quilters, the lock stitch is commonly used. Lock stitch machines, with their needle and bobbin arrangement, have been made somewhat able to tolerate or avoid needle deflection problems that can result in a missing of stitches when a needle is deflected. Needle deflection is more of a problem when quilting thick materials and complex patterns that involve many directional changes in the sewing path, particularly where higher sewing speeds are used. The lock stitch also provides equally aesthetically acceptable stitching on both sides of the fabric.

The multi-needle quilters are regarded as preferable for sewing mattress covers. With mattress covers, the less attractive looper side stitch may be confined to the inside of the mattress cover on the backing layer of material that is not visible to the observer. Further, the double chain stitch heads of the multi-needle quilters apply a looper side thread from an external spool, which can accommodate a substantially larger thread supply than can the bobbin of a lock stitch machine. As a result, the lock stitch machine can be run longer before the need arises to replenish the bottom thread supplies. The bobbins of the lock stitch machines require frequent changing, particularly with thick multilayered materials such as mattress covers which require more thread per stitch. A drawback to the use of double chain stitch machines has been the greater likelihood for stitches to be missed as a result of needle deflection. This is in part because a double chain stitch requires the looper on one side of the material to enter a thread loop in close proximity to the needle that has passed through the material from the other side, which needle itself must pass through a thread loop presented by the looper. Misalignment of the needle and looper due to deflection of the needle can result in the missing of stitches which, in the formation of more highly decorative patterns, is undesirable for not only aesthetic reasons but because it can result in an unraveling of the stitched pattern. Attempts at high speed sewing on mattress covers, where the material is generally very thick and the outer or ticking layer of fabric may be heavy and even of an upholstery-like nature, produce unavoidable needle deflection.

With the increased use of computerized pattern control and the resulting ability to provide a wider variety of quilted patterns, particularly patterns of a high ornamental quality, there has been an increasing demand for an ability to sew more, more complex and larger patterns onto the covers of mattresses. To this end, equipment of the prior art such as discussed above has had limitations. Accordingly, there remains a need for a capability to stitch more highly ornamental and complex patterns onto mattress covers at high speed.

SUMMARY OF THE INVENTION

An objective of the present invention is to provide a computer controlled pattern quilting method and apparatus that will provide wide variety of quilted patterns, particularly patterns of a high ornamental quality. A particular objective of the present invention is to provide a quilting method and apparatus employing a single needle quilting head and having the capability of quilting at high speed, particularly on thick materials such as those used for mattress covers.

A further objective of the present invention is to provide a quilting method and apparatus having one or more independently moveable sets of single needle chain stitch quilting heads that will stitch at high speeds, particularly on thick materials. A particular objective of the present invention is to provide such a quilting apparatus and method that does not suffer adversely from needle deflection.

According to the principles of the present invention, a quilting machine is provided with at least one a set of chain stitch quilting heads that are independently moveable relative to each other and relative to the material being quilted. The machine is preferably web-fed and its method of use preferably includes 360° stitching onto material webs of thicknesses typical of those used for mattress covers. In accordance with the preferred embodiment of the invention, a single-needle double chain stitch quilting method and apparatus are provided with independently operable servo driven quilting heads that are each independently moveable relative to the material being quilted. The heads are preferably also independently movable relative to each other in at least one direction, preferably the transverse direction, and the operation of each of the heads is preferably also independent to allow for effective control of the cooperating positions of the needle and looper relative to each other. In the preferred and illustrated embodiment, the needle and looper heads are independently moved transversely to permit adjustment of the cooperating positions of the needle and looper in the transverse direction and the cycles of the needle and looper heads are relatively phased to allow adjustment of the cooperating positions of the needle and looper in the longitudinal direction.

The relative movements and operation of the heads are brought about by computer controlled servos that move and drive the heads so as to maintain the proper cooperative relationship between the needle and looper in accordance with whatever needle deflection takes place.

According to one embodiment, needle deflection is determined in advance by empirical measurements and data is stored in memory in a programmable microprocessor-based controller of the quilting machine. The stored measurements may be in the form of a look-up table or sets of formula, constants and/or parameters from which needle deflection compensation signals can be supplied to affect the operation of servo motors driving and moving the heads relative to each other and to the material being quilted. Preferably also, the stored empirical data include alternative data that will provide needle deflection compensation for different conditions, such as different materials and fabrics, needles that differ in size or stiffness, varying stitch speeds and stitch sizes, and or other variables that can have an effect on the amount and direction of needle deflection that is expected to occur or does occur.

In accordance with the preferred embodiment of the invention, a quilting machine is provided with web supplies of the various layers of a mattress cover, which webs are brought together in the form of a multiple layered web and fed onto a machine frame, preferably in a horizontal plane. The frame preferably includes a plural belt conveyor that supports the web and aids in the advancement of the web onto the frame. A pair of side edge grippers, which may be in the form of opposed belt grippers, pin chains, clamping finger sets or other side securements, engage the opposite side edges of the web and move the web onto the frame in synchronism with the operation of the belt conveyor. The machine may optionally be provided with a pair of edge stitching heads to at least temporarily stitch together the layers of material of the portion of the web that is advanced onto the frame. Once on the frame, the edge clamps as well as tension rolls at the front and back of the frame tension a portion of the web for quilting.

The quilting is performed by a pair of heads that are each mounted to a bridge structure that is moveable longitudinally on the frame. The bridge is moveable on the frame by a computer controlled servo motor that positions the set of heads in accordance with the pattern to be stitched. Each of the heads is mounted on the bridge so as to be independently transversely moveable. Each head, including an upper needle head and a lower looper head, is provided with a servo motor drive that drives the respective head through its stitching cycle. The two head drive servo motors are operated in synchronism under computer control to sew series of double chain stitches in the fabric. Each head is mounted to the bridge on a linear servo motor that independently positions the head transversely on the frame under the control of the programmed controller of the machine in accordance with the pattern to be stitched.

Needle deflection is accommodated in one of, and preferably both of, two ways. First, needle deflection is accommodated by providing either a table of correction values, or preferably a correction formula based on several empirical constants, and a program in a memory accessible by a microprocessor of the controller in response to which the controller may vary control signals to the servos to control the positions of the heads relative to each other and the relative operational phases of the heads in a way that will compensate for whatever needle deflection is likely to occur. Second, needle deflection is accommodated by sensing certain conditions or parameters. The sensing can be a sensing of those machine conditions, such as speed, load or power demand or torque angle of servo motors, needle or looper position, or some other relevant machine condition that have a relation to needle deflection, or can be achieved by directly sensing the deflection of a needle. The sensing may be provided by reading data already present in the controller, by reading control signals being sent to machine servos and other drive elements or by monitoring various sensors separately provided on the machine to sense machine element status or the properties or states or the material or of the thread.

The method used for determining or predicting needle deflection can use any of the above described methods or combinations of the above described methods. For example, the first order of predicting needle deflection can be by the use of lookup tables, based on empirical or experimental data or theoretical data, from which tables corrective actions may be selected in response to, for example, measurements of sewing speed or input parameters such as fabric thickness. This estimate can provide for substantial corrective action being taken before actual deflection of the needle occurs. Further, actual needle deflection can be measured by sensors, such as magnetic or induction sensors, LED array sensors that may be infrared sensors, pictorial vision systems, ultrasonic detection systems, strain gage sensors, accelerometer sensors, or other techniques. A detected error can be used to adjust the lookup table produced response to anticipate and correct the error as the quilting proceeds.

Preferably, transverse deflection of the needle is provided by differently driving the heads transversely so that the looper and needle align whether or not the needle is deflected transversely. Preferably also, longitudinal deflection of the needle is provided by controlling the relative phases of the head drive servos so that the needle and looper engage at the proper time in the cycle whether or not the needle is deflected longitudinally.

The present invention provides for the high speed quilting of patterns on a web of thick fabric of the type of which mattress covers are made. A double chain stitch is sewn without the stitch quality being adversely affected by needle deflection, because servos drive the heads to provide for precise relative positioning. As a result, large spools of lower thread may be provided, eliminating the need to replenish bobbin thread supplies as would be the case with lock stitch machines. Overall higher operating speed and throughput is obtained.

These and other objects of the present invention will be more readily apparent from the following detailed description of the drawings in which:

DETAILED DESCRIPTION OF THE PREFERRED EMBODIMENT

Figure 1:
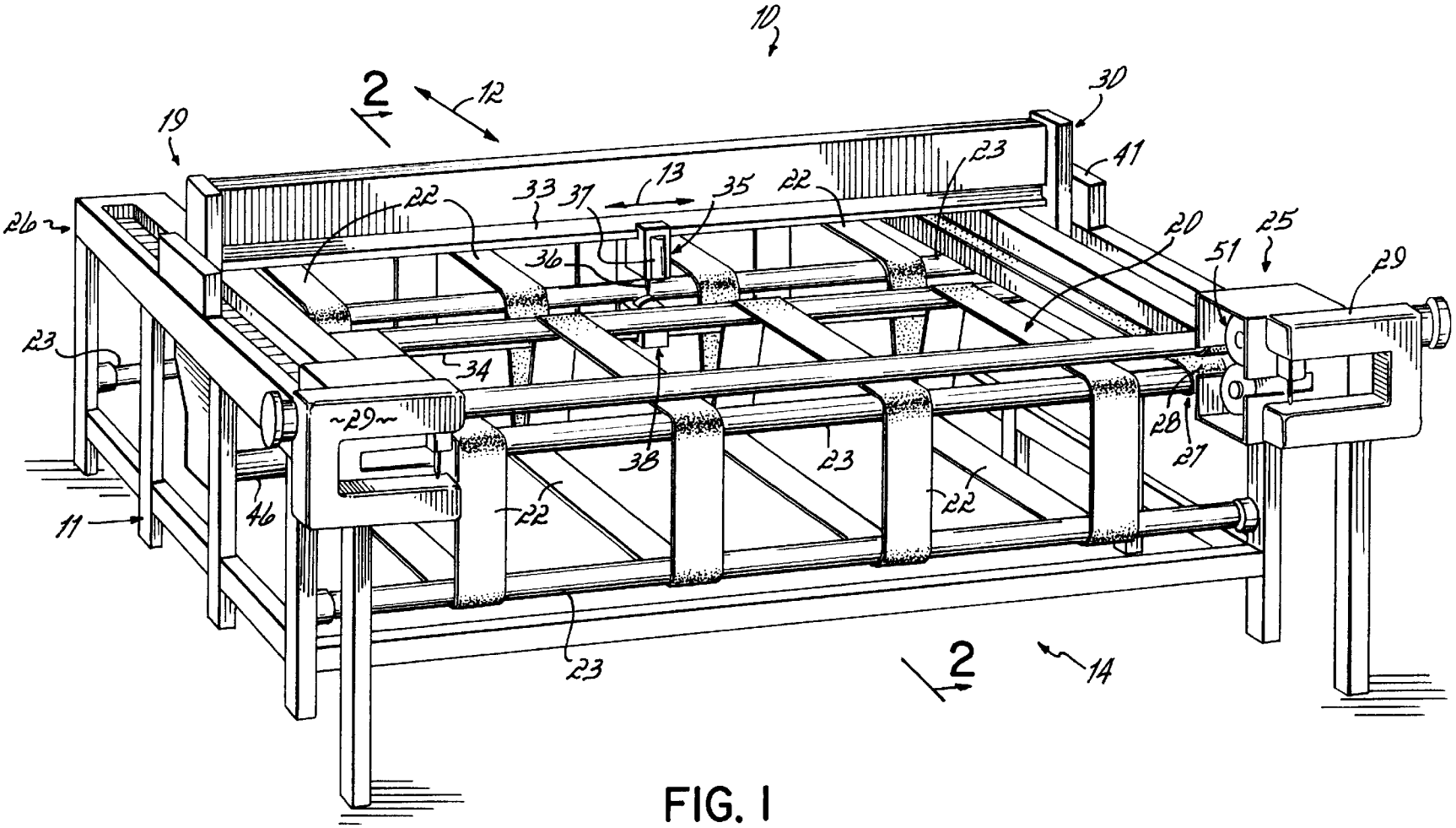
FIG. 1 is a perspective view of a web-fed mattress cover quilting machine embodying principles of the present invention.
Figure 2:
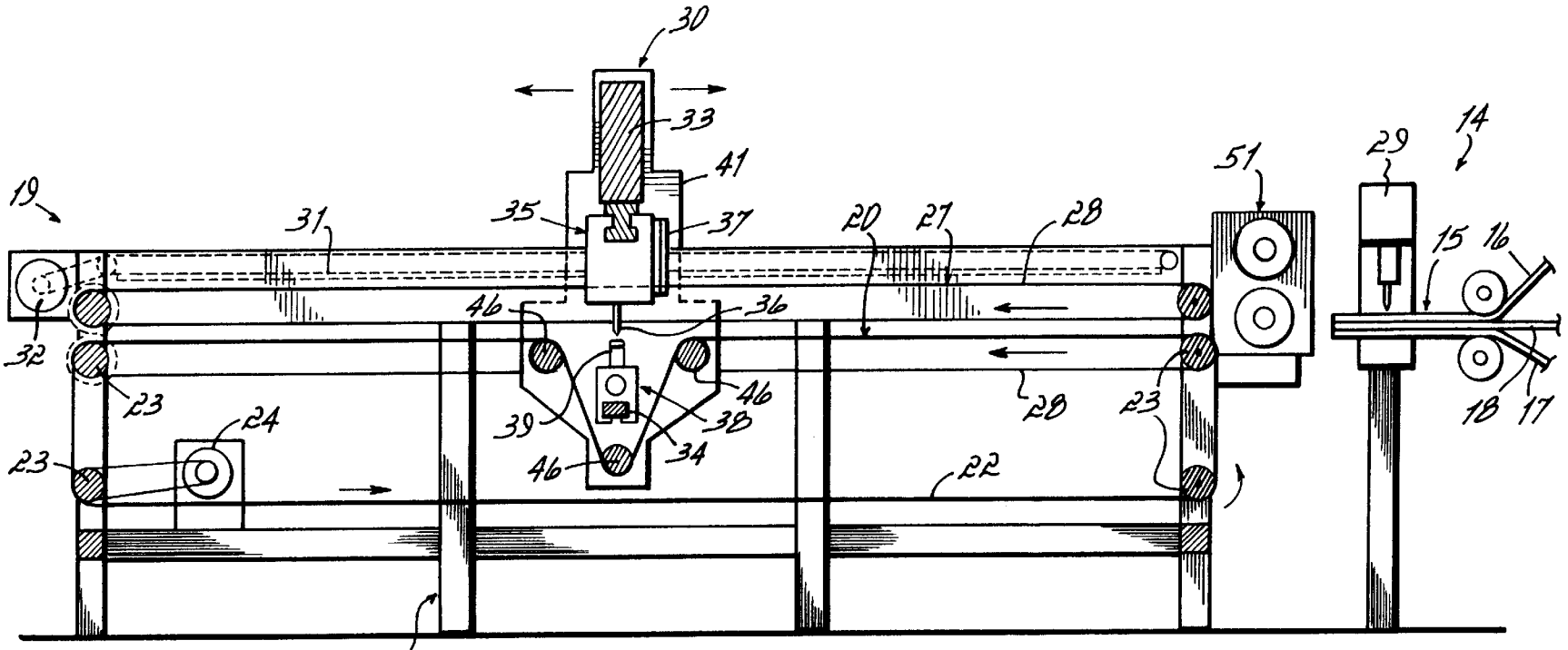
FIG. 2 is a side elevational view of the machine of FIG. 1.

FIGS. 1 and 2 illustrate a quilting machine 10 having a stationary frame 11 with a longitudinal extent represented by arrow 12 and a transverse extent represented by arrow 13. The machine 10 has a front end 14 into which is advanced a web 15 of multi-layered material that includes a facing material layer 16, a backing material layer 17 and a filler layer 18. The machine 10 also has a back end from which quilted multilayered material is advanced to a take-up or panel cutting section (not shown).

On the frame 11 is mounted a conveyor table 20 that includes a set of longitudinally extending belts 22 supported on a set of transverse rollers 23 journaled to the frame 11 to rotate thereon under the power of a drive motor 24. The motor 24 drives the belts 22 to advance the unquilted web 15 onto the frame 11 at the front end 14 thereof and to advance a quilted portion of the web 15 from the frame 11 to the take-up section at the back end 19 of the machine 10. The belts 22 support a panel of the web 15 in a horizontal quilting plane during quilting. The machine 10 also has a right side 25 and a left side 26, along each of which is mounted a side securement 27 in the form of a pair of opposed conveyor clamp belt or chain loops 28 that operate as a set of edge clamps to grip the edges of the web 15 to assist the feed of the web 15 onto and off of the frame 11 and to apply transverse tension to the web 15 in the quilting plane while a panel of the web 15 is being quilted. The securements 27 may be in the form of a series of gripping finger sets that are spaced along one of the loops 28 of the securements 27. Preferably, however, the securements 27 are preferably each in the form of a pin chain having a plurality of pins on one of the clamp loops 28 that penetrate the web 15 and extend into holes in the other of the clamp loops 28 of the respective pair. A pair of edge stitching heads 29 is also provided, one forward of each of the side securements 27 to temporarily stitch the layers 16–18 of the web 15 together for quilting. Immediately upstream of each of the stitching heads 29 is an edge slitter for trimming excess material to the outside of the edge stitch formed by the stitching heads 29. The loops 28 are linked to move in unison with the belts 22, which are driven by the drive motor 24 on the frame 11.

Figure 4:
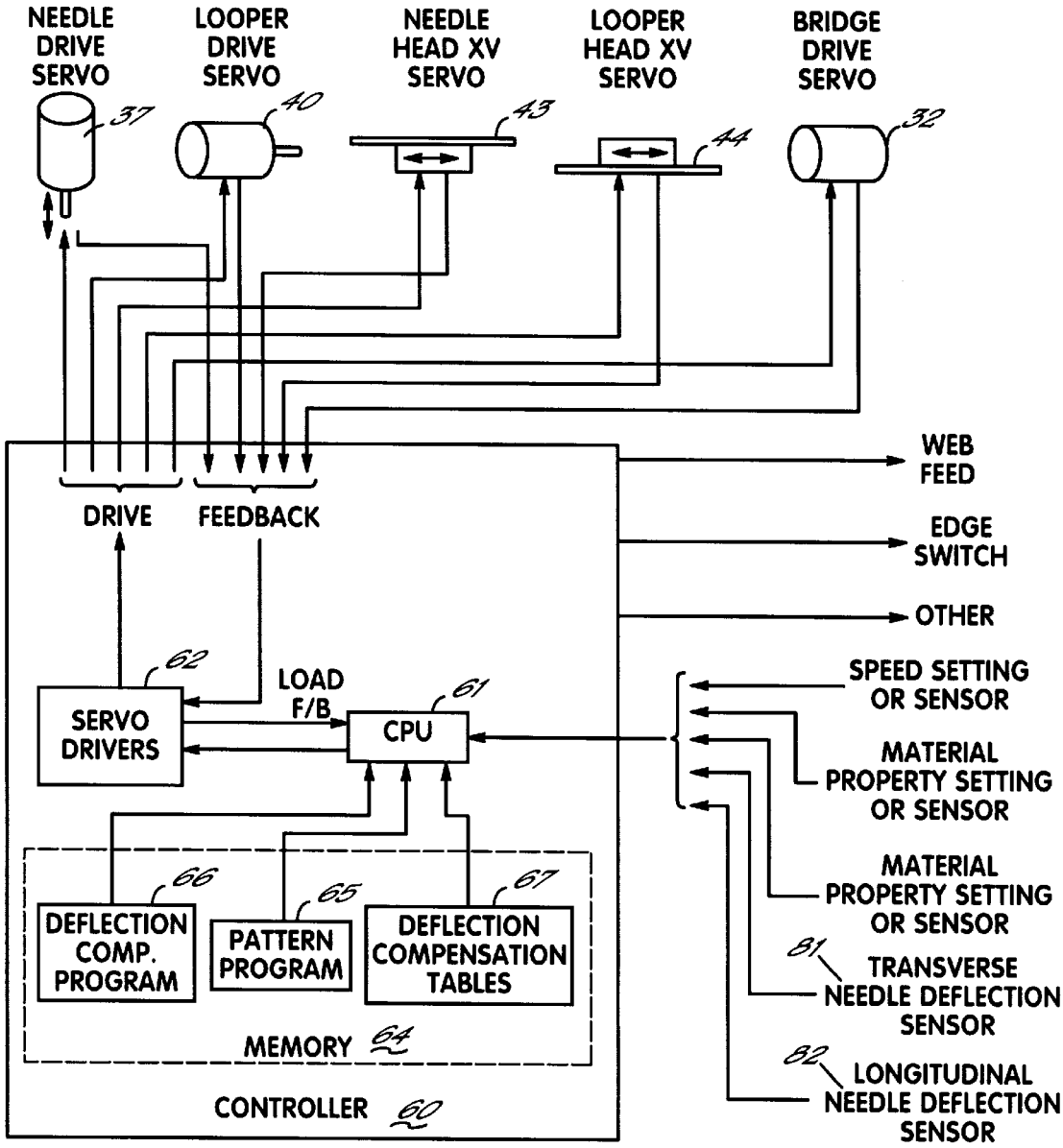
FIG. 4 is a diagrammatic representation of the control system of the machine FIG. 1.

The machine 10 has a sewing head bridge 30 mounted thereon that extends transversely across the frame 11 and is supported at each side of the frame 11 on a carriage 41. The bridge 30 carriages 41 are each mounted to move longitudinally on the frame 11 on a pair of tracks 31 on each side of the frame 11. The bridge is driven longitudinally on the tracks 31 by a bridge drive servo motor 32, mounted on the frame 11, which is responsive to signals from a machine controller 60 (FIG. 4).

The bridge 30 has a pair of transverse rails extending from one side of the frame 11 to the other, including an upper rail 33 and a lower rail 34. On the upper rail 33 is mounted an upper quilting head 35 that includes a needle 36 and a needle drive servo motor 37 (FIG. 3), which reciprocally drives the needle in a sewing cycle in response to signals from the machine controller 60. On the lower rail 34 is mounted a lower quilting head 38 that includes a looper 39 and a looper drive servo motor 40 (FIG. 3), which rocks the looper 39 in an arc in a sewing cycle, in synchronism with the motion of the needle 36 in a relationship responsive to separate signals from the machine controller 60.

The upper quilting head 35 is moveable transversely on the upper rail 33 by a linear servo motor 43 in response to signals from the controller 60, while the lower quilting head 38 is also moveable transversely on the lower rail 34 by a linear servo motor 44 in response to signals from the controller 60 independently of the upper head 35. Both of the linear servo motors 43 and 44 are preferably of the iron core type, such as the Ironcore Series of motors manufactured by Koll Morgen Motion Technologies Group of Commack, N.Y.

Figure 3:
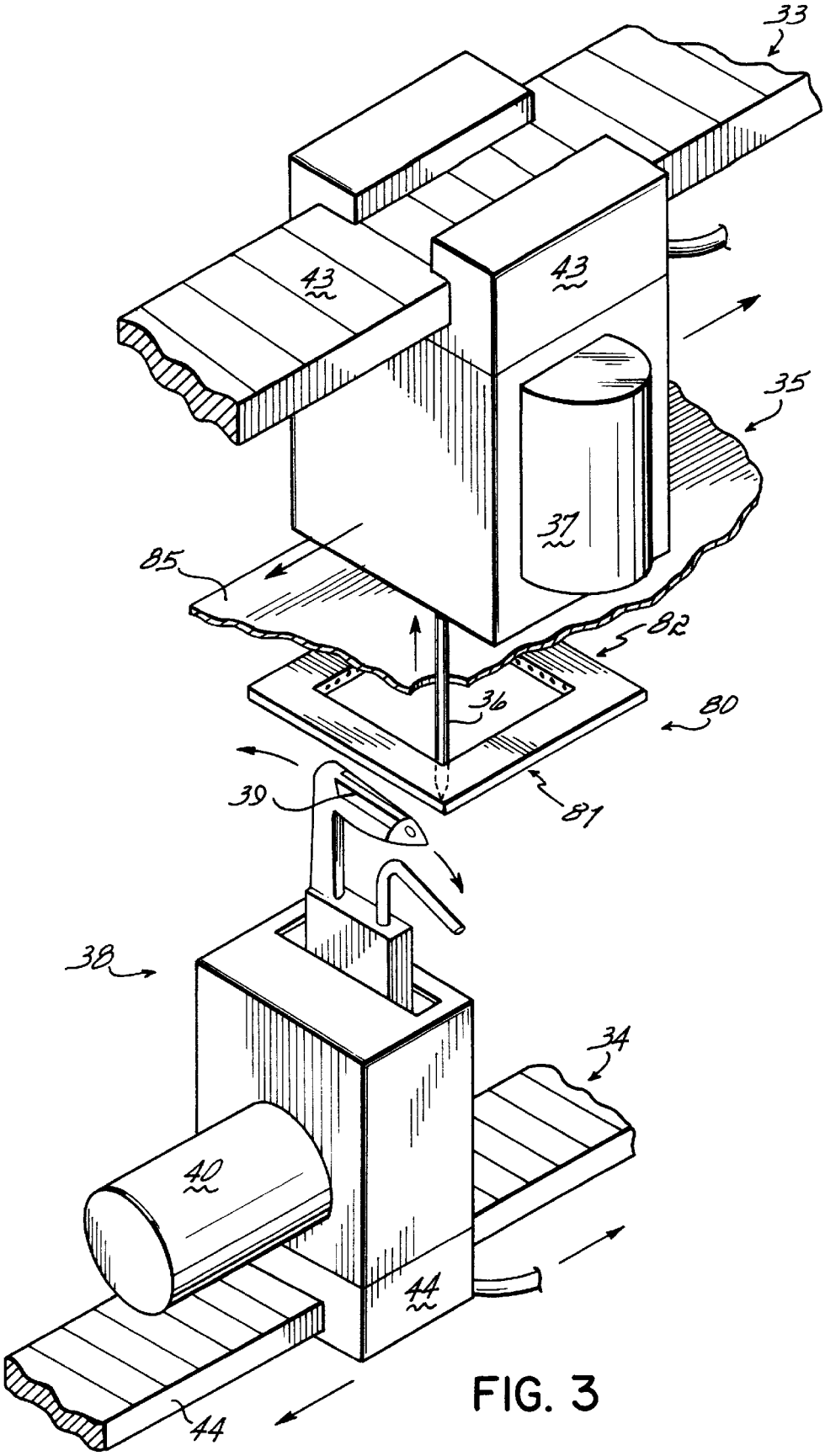
FIG. 3 is a diagrammatic perspective view of the sewing heads of the machine of FIG. 1.

The bridge 30 carries a set of three idler rollers 46 that move longitudinally on the frame 11 with the bridge 30. The rollers 46 direct the belts 22 downwardly in a loop 47 below the lower rail 34 and lower quilting head 38 to permit the lower quilting head 38 to pass between the belts 22 and the web 15. The loop 47 moves with the bridge 30 and remains aligned with the bridge 30 directly below the lower quilting head 38.

in a preferred embodiment of the machine 10, a needle deflection sensor 80 is provided to measure the actual deflection of the needle 36. As illustrated in FIG. 3, the sensor 80 may take the form of an LED array mounted beneath needle plate 85 on which the fabric 15 that is being quilted rests. The LED array sensor 80 may, for example, include a transverse deflection portion 81 and a longitudinal deflection portion 82, to provide orthogonal coordinate information to the controller 60 of the actual deflection of the needle 36 in the transverse and longitudinal directions. Each of the portions 81, 82 of the needle deflection sensor 80 include arrays of emitting and receiving LEDs positioned on opposite sides of the needle opening in the needle plate 85, with those of the transverse portion being situated along the sides of a rectangular arrangement of LEDs and those of the longitudinal portion being situated do along the front and back sides thereof. This device generates two outputs, one for transverse deflection and one for horizontal deflection, to the controller 60. These outputs can easily be zeroed by setting them to zero on the control interface when the needle 36 is stationary and extending through the needle opening in the needle plate 85, without horizontal deflection forces on the needle 36. This set of conditions results in the centerline of the needle 36 being in the longitudinal plane 72 and transverse plane 76 in FIGS. 5–5C and FIGS. 6–6C. The density of the individual detectors of the array is determined by the deflection measurement resolution required to insure accurate deflection compensation to the degree necessary to avoid missing stitches due to the looper or needle missing loops. Such a deflection sensor 80 can produce either analog or digital signals to the controller 60 representative of the amount of the deflection of the needle 36 from its zeroed position.

Alternative forms of sensors can be provided. Magnetic detectors, for example, are available suitable for the purpose. Whatever the form of the sensor 80, the outputs from the sensor provide the controller 60 with the ability to compensate for needle deflection by closed loop feedback, which may be carried out as a second order correction to predicted needle deflection based on the consideration of other parameters.

The interconnection of controller 60 with the servos 32, 37, 38, 43 and 44 is diagrammatically illustrated in FIG. 4. The controller 60 includes a CPU or microprocessor 61 and a servo driver module 62. The servo driver module 62 has outputs on which signals are communicated for driving the servos 32, 37, 38, 43 and 44 and has inputs for receiving feedback signals from the servos 32, 37, 38, 43 and 44 to maintain the servos 32, 37, 38, 43 and 44 at positions calculated by CPU 61. Inputs are provided the controller 60 to receive sewing speed setting or measurement information, to receive data of material properties that could affect needle deflection and inputs from the needle deflection sensor 80 with information of the actual needle deflection in the transverse and longitudinal directions.

The controller 60 also includes a non-volatile memory module 64 that includes a pattern implementation program 65, a needle deflection compensation program 66 and deflection compensation data 67, that may include lookup tables or stored constants or coefficients for use by a compensation formula in the compensation program 66. The controller 60 also has outputs to other components of the machine 10, including the web feed motors 24, the edge stitch units 29 and other machine motors and actuators not relevant to the present invention.

The controller 60 moves the bridge 30 by driving the bridge drive servo 32, and moves the linear servos 43 and 44 to move the quilting heads 35 and 38 in unison in accordance with the stitching pattern provided by the pattern program 65. These movements are carried out in coordination with the driving of the needle drive servo 37 and looper drive servo 40 to stitch patterns with stitches of controlled lengths.

In addition to the programed stitching of the patterns in accordance with the program 65, the CPU 61 modifies signals sent to the drivers 62 by differentially driving the transverse linear servos 43 and 44 to offset the needle 36 and the looper 39 transversely by a distance of preferably plus or minus approximately 0.1 inches, to an accuracy of preferably approximately 0.001 inches. The offset is determined, preferably at least partially, by the CPU 61 in response to a deflection compensation program 66 and empirical data in deflection tables 67 in an amount necessary to precisely compensate for the transverse deflection of the needle 36 that is expected to occur. The offset is also determined, preferably at least partially, by the measurements of actual needle deflection from the output of the sensor 80.

Further, in accordance with the program 65, the CPU 61 also modifies signals sent to the drivers 62 by differentially driving the looper drive servo 40 so as to advance or retard the phase of the looper 39 relative to the needle 36 to longitudinally offset the loop take positions of the needle 36 and the looper 39 a phase angle of preferably plus or minus approximately 2.5° to a minimum accuracy of preferably approximately 0.25°. The offset is determined by the CPU 61 in response to a deflection compensation program 66 and empirical data in deflection tables 67 in an amount necessary to precisely compensate for the longitudinal deflection of the needle 36 that is expected to occur.

Figure 5:
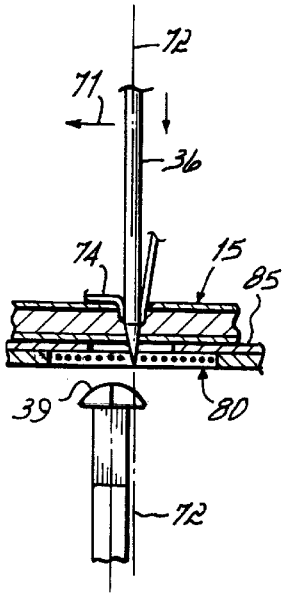
FIGS. 5–5C are sequences of diagrams representing needle deflection problems that can occur in the high speed chain stitch quilting of thick fabrics.
Figure 5A:
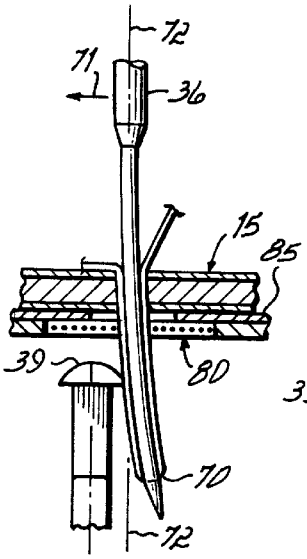
Figure 5B:
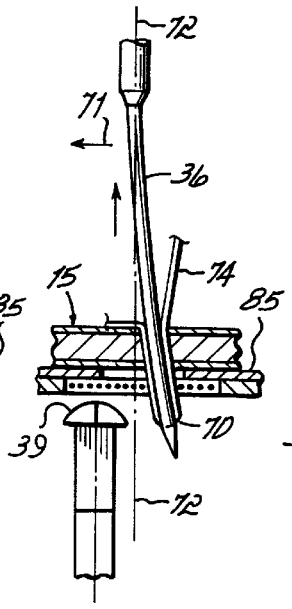
Figure 5C:
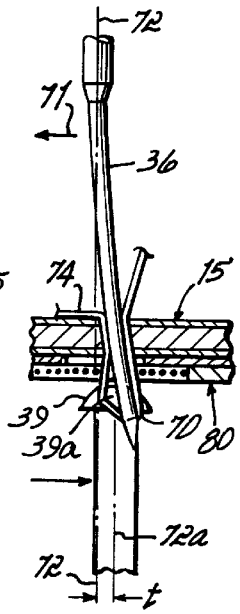

FIGS. 5–5C diagrammatically illustrates in front view a series showing how the needle 36 might deflect in transverse direction. In FIG. 5, the needle 36 is shown as it begins to pierce the web 15 in the downward part of its cycle in a portion of a pattern at which the web 15 is moving transversely relative to the needle 36, as represented by the arrows 71. At this point in the cycle, the centerline of the needle 36 lies on a vertical centerline of the upper head 35 that lies in longitudinal plane 72, which centerlines are the line of normal alignment of the needle 36 at which the looper 39 would, if the needle 36 were to remain in the longitudinal plane 72, bring the needle 36 into a loop engaging relationship with the looper 39 below the web 15. At this point, the transverse deflection determining portion 81 of the needle deflection sensor 80 should be outputting a signal indicating that the transverse deflection is essentially zero. By the time the needle 36 has reached the bottom extent in its cycle, as illustrated in FIG. 5A, the relative motion of the needle 36 relative to web 15 results in a bending of the needle 36 to the right in the figure, which moves the tip of the needle 36 away from the plane 72 and out of alignment with the path of the looper 39. At this point, the transverse deflection determining portion 81 of the needle deflection sensor 80 should be outputting a signal indicating the magnitude of the transverse deflection of the needle 36 at the point it crosses the horizontal plane in which the sensor 80 is mounted. The controller 60 calculates from this the actual configuration of the needle 36 in its bent or deflected state. In this position, the looper 39 is in a retracted position moving forward in a path that is supposed to pass between the needle 36 and top thread 74 that runs through the eye 70 of the needle 36. As the needle 36 ascends, as is illustrated in FIG. 5B, the needle 36 moves to a plane through which the looper 39 is moving forwardly and at which the looper 39 is supposed to pass between the needle 36 and top thread 74. However, due to the deflection of the needle 36 to the right caused by the continued motion of the web 15 relative to the centerline 72 of the upper head 35, the looper 39 misses the thread 74.

In accordance with certain embodiments of the present invention, under the conditions illustrated, the CPU 61 recognizes the needle deflection condition and determines the direction and amount of transverse deflection of the needle 36, then retrieves information 67 stored in the memory 64 and calculates the amount of compensation necessary to position the looper 39 so as to insure that the looper 39 passes between the needle 36 and the top thread 74. This amount of transverse compensation is represented by the dimension t in FIG. 5C. Movement of the lower head 38 relative to the normal position of the upper head 35 places the looper 39 in position 39*a* in a vertical longitudinal plane 72*a*, displaced a distance t from the plane 72 that passes through the proper point for the looper 39 to pass between the needle 36 and the top thread 74.

Preferably, the CPU makes corrections by generating the main component of the signal to the servos 43 and 44 in accordance with the pattern program 65. Then, this signal is modified by the substantially smaller deflection compensation signal read by the program 66 from the table 67 that modifies one or both of the signals to the servos 43 and 44. The CPU further uses the output from the needle deflection sensor 80 to determine if the predicted deflection derived from the lookup tables is correct and that the correction has been adequate. If not, an adjustment to the correction is calculated and stored for use in calculating further corrections. Preferably, transverse needle deflection compensation is made to the looper head positioning servo 44.

Figure 6:
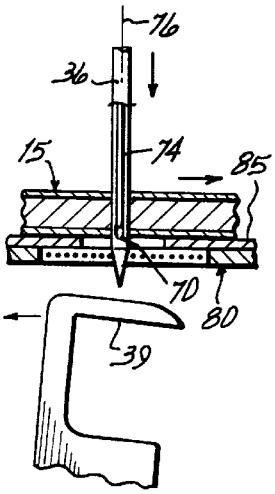
FIGS. 6–6C are sequences of diagrams representing needle deflection compensation in accordance with principles of the present invention.
Figure 6A:
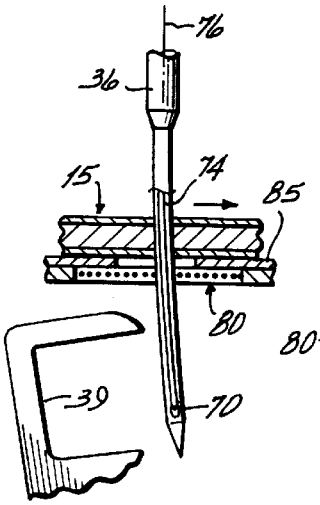
Figure 6B:
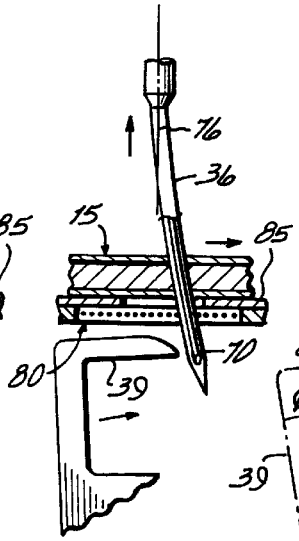
Figure 6C:
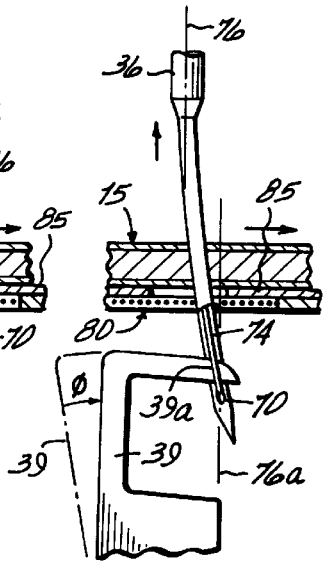

The longitudinal correction for needle compensation works in a somewhat different manner. In FIGS. 6–6C there is diagrammatically illustrated a series of side views showing how the needle 36 can deflect in the longitudinal direction. In FIG. 6, the needle 36 is shown as it begins to pierce the web 15 in the downward part of its cycle in a portion of a pattern at which the needle 36 is moving longitudinally relative to the web 15, as represented by the arrows 75. As in the case of transverse needle deflection, the deflection sensor 80 should output a signal indicating that there is no deflection of the needle 36 occurring in this position. At this point in the cycle, the needle 36 lies in a vertical transverse plane 76 that contains the vertical centerline of the upper head 35, which is the line of normal alignment of the needle 36 with the looper 39 and the line that contains the position at which the looper 39 would, if the needle 36 were to remain in the plane 76, bring the needle 36 into contact with the looper 39 below the web 15 and pass between the needle 36 and the top thread 74. By the time the needle 36 has reached the lowest point in its cycle, as illustrated in FIG. 6A, the relative motion of the needle 36 relative to the web 15 results in a bending of the needle 36 forward (to the right in FIG. 6A), which moves the needle 36 away from the plane 76 of the normal intercept point of the needle 36 with the looper 39. At this time, the looper 39 is in a retracted position moving forward in a path that is supposed to pass between the needle 36 and top thread 74 that runs through the eye 70 of the needle 36. As the needle 36 ascends, as is illustrated in FIG. 6B, the needle 36 moves to adjacent the point through which the looper 39 is moving forwardly and at which the looper 39 is intended to pass between the needle 36 and top thread 74. However, due to the deflection of the needle 36 to the right (forward) caused by the continued motion of the upper head 35 relative to the web 15, the looper 39 misses the thread 74.

In accordance with certain embodiments of the present invention, under the conditions illustrated, the CPU 61 recognizes the condition and determines the longitudinal deflection of the needle 36, then retrieves information 67 stored in the memory 64 and calculates of the amount of compensation necessary to position of the looper 39 so as to insure that the looper 39 passes between the needle 36 and the top thread 74. Preferably, actual needle deflection is measured by the longitudinal portion 82 of the sensor 80 which is used to make adjustments to the calculated correction that is necessary. The amount of longitudinal compensation is in the form of an angular adjustment or relative phase angle in the drive cycles of the heads 35 and 38 as controlled by the operation of the servos 37 and 40. The phase difference is represented by the angle $\phi$ in FIG. 6C. Phasing of the looper drive 40 relative to the normal looper angle places the looper 39 in position 39*c* in transverse vertical plane 76*a* that passes through the proper point for the looper 39 to pass between the needle 36 and the top thread 74.

According to alternative embodiments of the invention, data from sensors can supply the controller 60 with information of the actual deflection of the needle 36. in FIGS. 3, 5–5C and 6–6C, for example, an infrared sensor 80 in the form of an LED array is fixed to the bottom of conventional needle plate 85 which supports the fabric 15 being quilted. The sensor 80 has a rectangular arrangement surrounding the hole in the plate 85 through which the needle 36 passes. The sensor 80 may include, for example, a row of light sources on one transverse side and one longitudinal side of the needle 36 opposite a row of infrared LED detectors on each of the transverse and longitudinal sides opposite the sources. The sources and detectors can be connected by fiber optic conductors to the sensor array.

A longitudinal deflection detector portion 81 has elements on the sides of the needle 36 to detect longitudinal needle position at its point of intersection with the plane of sensor 80, while the transverse deflection sensor 82 has elements on the longitudinal sides of the needle 36 which detect the transverse position of the needle at its point of intersection of the plane of the sensor 80. Both sensor portions 81,82 are zeroed at the controller 60 when no horizontal forces are on the needle. This is accomplished by cycling the machine 10 slowly with no fabric 15 on the needle plate 85. Sensors available to perform the function of sensors 80 include laser through-beam photoelectric sensor, LX series, such as LX-130, cat. no. KA-SW-31, manufactured by Keyance Corporation of America, Woodcliff Lake, N.J., or glass fiber optic sensor series BMM-442P, manufactured by Banner Engineering Corporation of Minneapolis, Minn.

The sensors 81,82 are connected to inputs of the CPU 61, as illustrated in FIG. 4. The CPU 61 may be programmed to compensate for the detected deflection of the needle 36 by straight forward closed loop feedback logic. Signals from the sensors 81, 82 may also be used by the controller 60 to supplement or adjust deflection compensation predictions, or to refine predictions, that are based on data from the lookup table 67, either by updating the data in the table 67, by updating the program 66, or by providing a temporary correction to the output of the program 66 that is based on data from the lookup table 67.

Preferably, the CPU makes corrections by generating the main component of the signal to the servos 37 and 40 in accordance with the pattern program 65. Then, this signal is modified by the substantially smaller deflection compensation signal read by the program 66 from the table 67 that modifies one or both of the signals from the controller 60 to the servos 37 and 40. Preferably, the compensation is made to the looper drive servo 40.

Concepts of the invention may also be applied to alter the transverse motion of the upper head 35 by operation of the servo 43 or to alter the longitudinal motion of both heads 35 and 38 by affecting movement of the bridge 30 by servo 32 so as to decrease, at least in part, the amount of needle deflection. This, in effect, produces an indexing motion to the quilting heads 35 and 38 relative to the web 15, which is not fully practical in high speed quilting processes.

Details of machines 10 of the above described embodiment that are known in the art can be found in U.S. patent application Ser. No. 08/497,727, filed Jun. 30, 1995 entitled Quilting Method and Apparatus, which relates to single needle quilters but of the lock stitch type, and in U.S. Pat. No. 5,154,130, which relates to web-fed chain stitch quilters but of ganged multi-needle type, both of which are assigned to the assignee of the present invention and are hereby expressly incorporated by reference herein.

More than one set of independently driven heads may be supported on the frame 11. For example, two sets of heads 35,38 may be supported for transverse movement on the bridge 30, each separately controllable in the transverse direction and each separately driveable to stitch patterns on the web 15, with separate control thereof to compensate separately for the needle deflection that would occur at each head.

Those skilled in the art will appreciate that various changes and additions may be made to the embodiments described above without departing from the principles of the present invention. Therefore, the following is claimed:

What is claimed is:

1. An apparatus for quilting a thick multilayered material comprising:

support structure operable to hold the material for quilting in a plane;

a pair of chain stitch forming heads moveable parallel to the plane on opposite sides of the plane, the heads including a needle head including a needle reciprocatable through the plane and a looper head including a looper reciprocatable proximate the needle and adjacent the plane to quilt the material held by the support structure;

at least two drive motors, including a needle drive operable to reciprocate the needle through material held in the plane and a looper drive operable to reciprocate the looper proximate the needle adjacent the plane;

a controller operable to control the drive motors in synchronized cycles to quilt the material with a series of chain stitches in accordance with a programmed pattern;

at least two transverse head positioning servo motors each independently operable in response to signals from the controller;

at least one longitudinal head positioning servo motor operable in response to signals from the controller;

a needle deflection information source connected to an input of the controller;

the controller including a program to operate the controller to calculate needle deflection compensation in response to needle deflection information from the source;

the controller being operable to send signals to the motors in response to the calculated needle deflection compensation to relatively move the needle and looper to compensate for needle deflection in the formation of the series of stitches.

2. The apparatus of claim 1 wherein:

the needle deflection information source includes a memory in which is stored needle deflection data.

3. The apparatus of claim 1 wherein:

the needle deflection information source includes a memory in which is stored needle deflection data and sensors responsive to motion detected from the heads, the controller being operative to calculate the deflection compensation in response to stored needle deflection data selected in response to information from the sensors.

4. The apparatus of claim 1 wherein:

the needle deflection information source includes a sensor operative to sense deflection of the needle and to send a signal to the controller in response to the sensed deflection of the needle.

5. The apparatus of claim 4 wherein:

the needle deflection information source includes an LED array responsive to deflection of the needle.

6. The apparatus of claim 4 wherein:

the needle deflection information source includes an infrared sensor responsive to deflection of the needle.

7. The apparatus of claim 4 wherein:

the needle deflection information source includes a magnetic sensor responsive to deflection of the needle.

8. The apparatus of claim 1 wherein:

the needle deflection information source includes sensors responsive to the deflection of the needle, the controller being operative to calculate the deflection compensation in response to information of the deflection of the needle.

9. An apparatus for quilting a thick multilayered material comprising:

means for supporting a multilayered material in a plane;

at least two chain stitch forming heads, including a needle head having a reciprocatable needle and a looper head having a reciprocable looper, the heads being moveable parallel to the plane on opposite sides of the plane;

means for separately operating the heads and for independently moving the heads relative to the material to quilt a programmed pattern on the supported material; and means for determining deflection of the needle;

programmed means for controlling the separate and independent motion of the operating means in response to the deflection determining means to form a series of chain stitches in the shapes of predetermined patterns so as to maintain the needle and looper in alignment during deflection of the needle.

10. The apparatus of claim 9 wherein:

the deflection determining means includes a sensor operable to detect deflection of the needle and to generate a deflection signal to the programmed means in response to the detected deflection.

11. The apparatus of claim 9 wherein:

the deflection determining means includes a memory in which is stored needle deflection compensation data and a program for operating the heads in accordance with the data.

12. A method of quilting a thick multilayered material comprising:

supporting a multilayered material in a plane for quilting;

providing a pair of chain stitch forming heads, including a needle head having a moveable needle and a looper head having a moveable looper, the heads being moveable parallel to the plane on opposite sides of the plane;

providing a plurality of motors to operate and move the heads to quilt the material supported in the plane;

determining deflection of the needle; and separately controlling the motors to operate and move the heads to quilt a chain stitched pattern in response to the needle deflection determination so as to maintain the deflected needle and the looper in alignment.

13. The method of claim 12 further comprising the step of:

differently adjusting the operation of the motors to independently position the heads so as to compensate for needle deflection in the formation of the stitched patterns.

14. The method of claim 12 further comprising the step of:

differently adjusting the operation of the motors to independently phase the heads so as to compensate for needle deflection in the formation of the stitched patterns.

15. The method of claim 12 wherein:

the deflection determining step includes sensing the deflection of the needle.

16. The method of claim 12 wherein:

the deflection determining step includes the step of providing an LED array and sensing therewith the deflection of the needle.

17. The method of claim 12 wherein:

the deflection determining step includes the step of providing an infrared sensor and sensing therewith the deflection of the needle.

18. The method of claim 12 wherein:

the deflection determining step includes the step of providing a magnetic sensor and sensing therewith the deflection of the needle.

19. The method of claim 12 wherein:

the deflection determining step includes the step of storing a table of needle deflection compensation data;

selecting the compensation data in response to operating parameters of the quilting apparatus; and controlling the heads in accordance with the selected data to maintain the needle and looper in alignment.

* * * * *